US008066343B2

(12) United States Patent
Nishihara

(10) Patent No.: US 8,066,343 B2
(45) Date of Patent: Nov. 29, 2011

(54) LIQUID DETECTING APPARATUS AND LIQUID EJECTING APPARATUS

(75) Inventor: Yuichi Nishihara, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 863 days.

(21) Appl. No.: 12/108,271

(22) Filed: Apr. 23, 2008

(65) Prior Publication Data

US 2008/0259104 A1 Oct. 23, 2008

(30) Foreign Application Priority Data

Apr. 23, 2007 (JP) ..... 2007-112782

(51) Int. Cl.
*B41J 2/195* (2006.01)

(52) U.S. Cl. ..... 347/7; 347/19

(58) Field of Classification Search ..... 73/290 R, 73/290 B, 290 V; 347/7, 19
See application file for complete search history.

(56) References Cited

U.S. PATENT DOCUMENTS

| | | | | |
|---|---|---|---|---|
| 4,034,380 | A * | 7/1977 | Isayama | 347/19 |
| 4,176,543 | A * | 12/1979 | Nolte et al. | 73/40.5 A |
| 5,627,571 | A * | 5/1997 | Anderson et al. | 347/19 |
| 6,536,275 | B1 * | 3/2003 | Durkee et al. | 73/290 V |
| 6,914,555 | B2 * | 7/2005 | Lipscomb et al. | 342/124 |
| 2003/0103131 | A1 * | 6/2003 | Arakawa | 347/106 |
| 2004/0168514 | A1 * | 9/2004 | Tsukada et al. | 73/290 V |
| 2005/0247126 | A1 * | 11/2005 | Eguchi et al. | 73/304 R |
| 2006/0038858 | A1 * | 2/2006 | Ishizaki | 347/68 |
| 2007/0279446 | A1 * | 12/2007 | Ishizaki | 347/19 |

FOREIGN PATENT DOCUMENTS

| | | | |
|---|---|---|---|
| JP | 2001-146030 | A | 5/2001 |
| JP | 2002-154216 | A | 5/2002 |
| JP | 2002-154222 | A | 5/2002 |
| JP | 2002-286525 | A | 10/2002 |
| JP | 2003-112431 | A | 4/2003 |
| JP | 2004-050824 | A | 2/2004 |
| JP | 2004-261970 | A | 9/2004 |
| JP | 2004-261971 | A | 9/2004 |
| JP | 2004-261982 | A | 9/2004 |
| JP | 2006-142515 | A | 6/2006 |
| JP | 2006-212828 | A | 8/2006 |

* cited by examiner

*Primary Examiner* — Charlie Peng
(74) *Attorney, Agent, or Firm* — Sughrue Mion, PLLC

(57) ABSTRACT

The invention relates to a liquid detecting apparatus that drives a liquid detecting unit that outputs two detection signals having phases opposite to each other in accordance with the amount of liquid. The liquid detecting apparatus according to an aspect of the invention includes: a driving unit that outputs a driving signal to the liquid detecting unit; a differential amplifying unit that performs differential amplification on said two detection signals that are output from the liquid detecting unit on the basis of the driving signal so as to output a differential amplification detection signal; and a signal detecting unit that makes a judgment as to whether the amount of liquid is not less than a predetermined amount or not by means of the differential amplification detection signal input from the differential amplifying unit.

7 Claims, 6 Drawing Sheets

LIQUID DETECTING APPARATUS AND LIQUID EJECTING APPARATUS

BACKGROUND

1. Technical Field

The present invention relates to a liquid detecting apparatus that drives a liquid detecting unit so as to detect the presence or absence of a certain amount of liquid. In addition, the present invention further relates to a liquid ejecting apparatus that is provided with such a liquid detecting apparatus.

2. Related Art

A technique for detecting the presence or absence of a certain amount of liquid that is contained in a liquid container, an example of which is ink contained in an ink cartridge, is known in the technical field of a liquid detecting apparatus to which the present invention pertains. In the above-described technique for detecting the presence/absence of a certain amount of liquid contained in a liquid container of the related art, a piezoelectric element is used as a liquid detection sensor. In the related-art liquid detection technique, either the presence or absence of a certain amount of liquid such as ink is detected by means of, or, in other words, on the basis of, the waveform of a counter-electromotive voltage (i.e., back electromotive voltage) that is obtained after the piezoelectric element has been driven. More specifically, the liquid detecting apparatus of the related art detects the presence or absence of a certain amount of ink as follows. In the configuration of the liquid detecting apparatus of the related art, an ink flow channel is formed in the proximity of a piezoelectric element. The piezoelectric element generates residual vibration after application of a voltage thereto, and outputs an output signal as a result of the residual vibration. The liquid detecting apparatus of the related art makes a judgment as to whether a frequency that is obtained on the basis of the waveform of the output signal that was output as a result of the residual vibration agrees with one resonance frequency that is obtained under the conditions that the ink flow channel that is formed in the proximity of the piezoelectric element is filled with ink or another resonance frequency that is obtained under the conditions that the ink flow channel that is formed in the proximity of the piezoelectric element is not filled with ink. Then, on the basis of the result of the above-described judgment, the liquid detecting apparatus of the related art makes a further judgment as to whether the amount of ink that is contained in an ink cartridge is larger than, or, at the smallest, equals to, a predetermined threshold amount or not. An example of the ink detection technique of the related art explained above is disclosed in JP-A-2001-146030.

In a case where a driving circuit that drives a piezoelectric element is provided as a discrete driver that is separated from the piezoelectric element in order to obtain the waveform of a counter-electromotive voltage, there arises a problem in that the electrodes of the piezoelectric element are highly vulnerable to exogenous noise because the output impedance of the piezoelectric element is high. As an approach to address such a problem, it is possible to modify and thus improve the structure of an ink cartridge so as to reduce, suppress, or completely cancel and reject any exogenous noise. However, such a solution will inevitably make the manufacturing of an ink cartridge more complex, thereby, for example, increasing the number of manufacturing steps. Or, as another non-limiting disadvantage of such a solution, it will increase the cost of production thereof.

SUMMARY

An advantage of some aspects of the invention is to improve the detection accuracy of a liquid detecting apparatus without requiring any structural modification thereof.

In order to address the above-identified problem without any limitation thereto, the present invention adopts the following unique and characteristic configuration.

As a first aspect thereof, the invention provides a liquid detecting apparatus that drives a liquid detecting section that outputs two detection signals having phases opposite to each other in accordance with the amount of liquid. The liquid detecting apparatus according to the first aspect of the invention includes: a driving section that outputs a driving signal to the liquid detecting section; a differential amplifying section that performs differential amplification on the above-mentioned two detection signals that are output from the liquid detecting section on the basis of the driving signal so as to output a differential amplification detection signal; and a signal detecting section that makes a judgment as to whether the amount of liquid is not less than a predetermined amount or not by means of the differential amplification detection signal input from the differential amplifying section.

Since the liquid detecting apparatus according to the first aspect of the invention is provided with a differential amplifying section that generates a differential amplification detection signal by means of two antiphase detection signals that have phases opposite to each other, it is possible to reduce, suppress, or completely cancel and reject the adverse effects of any exogenous noise, thereby improving the detection accuracy of the liquid detecting apparatus.

It is preferable that the liquid detecting apparatus according to the first aspect of the invention should further include a high-pass filtering section that is provided between the liquid detecting section and the differential amplifying section. With such a preferred configuration, it is possible to remove or reduce low-frequency components that are generated in the liquid detecting section. Therefore, it is possible to further improve the detection accuracy of the liquid detecting apparatus.

In the configuration of the liquid detecting apparatus according to the first aspect of the invention, it is preferable that the liquid detecting section should have a first electrode and a second electrode; and the differential amplifying section should have a first input portion to which the first electrode of the liquid detecting section is electrically connected and a second input portion to which the second electrode of the liquid detecting section is electrically connected. When such a preferred configuration is adopted, the amplification of detection signals are performed by means of one detection signal that is input into the first input portion of the differential amplifying section and the other detection signal that is input into the second input portion thereof.

In the preferred configuration of the liquid detecting apparatus according to the first aspect of the invention described above, it is further preferable that a switch that electrically connects the driving section and the first electrode or electrically disconnects the driving section from the first electrode should be provided between the driving section and the first electrode. When such a preferred configuration is adopted, the driving section is electrically connected to the first electrode when the driving section drives the liquid detecting section, whereas the driving section is electrically disconnected from the first electrode when the signal detecting section performs signal detection.

In the preferred configuration of the liquid detecting apparatus according to the first aspect of the invention described above, it is further preferable that the driving section should include a first driving section and a second driving section; a first switch that electrically connects the first driving section and the first electrode or electrically disconnects the first driving section from the first electrode should be provided between the first driving section and the first electrode; and a second switch that electrically connects the second driving section and the second electrode or electrically disconnects the second driving section from the second electrode should be provided between the second driving section and the second electrode. When such a preferred configuration is adopted, the first driving section or the second driving section is electrically connected to the first electrode or the second electrode when the first driving section or the second driving section drives the liquid detecting section, whereas the first driving section or the second driving section is electrically disconnected from the first electrode or the second electrode when the signal detecting section performs signal detection.

In the preferred configuration of the liquid detecting apparatus according to the first aspect of the invention described above, it is further preferable that one of the first electrode of the liquid detecting section and the second electrode of the liquid detecting section should be provided at a position that is more susceptible to an external noise than a position at which the other of the first electrode of the liquid detecting section and the second electrode of the liquid detecting section is provided; and the high-pass filtering section should have a capacitor portion having the same capacitance as that of the liquid detecting section, the capacitor portion being provided at a side to which the above-mentioned one of the first electrode of the liquid detecting section and the second electrode of the liquid detecting section that is more susceptible to the external noise than the above-mentioned other thereof is electrically connected. With such a preferred configuration, in a case where there is a difference in an external noise that arises at the first electrode of the liquid detecting section and an external noise that arises at the second electrode thereof, it is possible to reduce external noise while making up such a noise difference. Therefore, it is possible to improve the detection accuracy of the liquid detecting apparatus.

As a second aspect thereof, the invention provides a liquid ejecting apparatus. A liquid ejecting apparatus according to the second aspect of the invention is provided with the liquid detecting apparatus according to the first aspect of the invention. The liquid ejecting apparatus according to the second aspect of the invention has a plurality of apparatus-side terminals that contact a plurality of terminals of the liquid detecting section, where the plurality of apparatus-side terminals constitutes an attachment portion to which a liquid container is attached. In such a configuration of the liquid ejecting apparatus according to the second aspect of the invention, the liquid detecting section that has the plurality of terminals is provided in the liquid container that can be detachably attached to the liquid detecting apparatus. The driving section is electrically connected to one of the apparatus-side terminals. The signal detecting section is electrically connected to one of the apparatus-side terminals via the differential amplifying section. With the above-described configuration, even in a case where the liquid detecting section is provided in the liquid container, it is possible to improve the detection accuracy of the liquid detecting apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

With reference to the accompanying drawings, an example of a liquid detecting apparatus according to the invention is described below while explaining exemplary embodiments thereof.

First Embodiment

Figure 1:
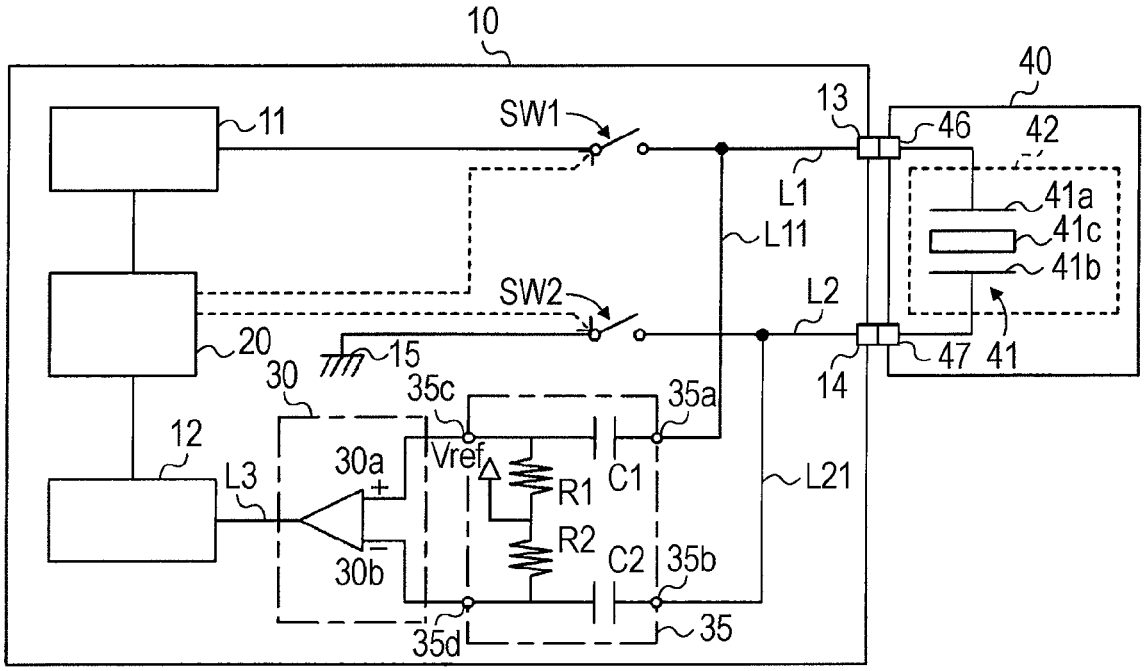
FIG. 1 is an explanatory diagram that schematically illustrates an example of the inner configuration of a liquid detecting apparatus according to a first embodiment of the invention.
Figure 2:
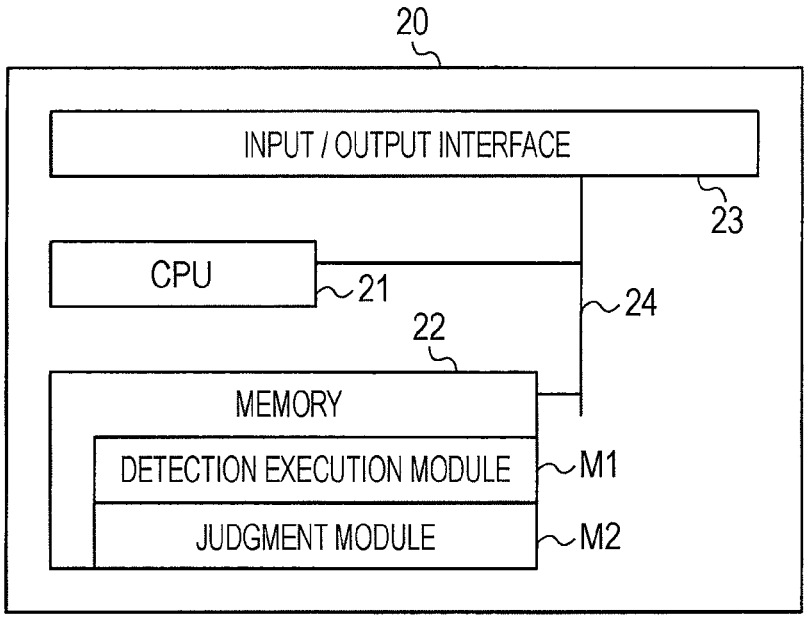
FIG. 2 is an explanatory diagram that schematically illustrates an example of the inner configuration of a control unit that is provided in a liquid detecting apparatus according to the first embodiment of the invention.

In the following description, an example of the configuration of a liquid detecting apparatus according to a first embodiment of the invention is explained while making reference to FIGS. 1 and 2. FIG. 1 is an explanatory diagram that schematically illustrates an example of the inner configuration of a liquid detecting apparatus according to the first embodiment of the invention. FIG. 2 is an explanatory diagram that schematically illustrates an example of the inner configuration of a control unit that is provided in a liquid detecting apparatus according to the first embodiment of the invention.

FIG. 1 shows a liquid detecting apparatus 10 according to the first embodiment of the invention. In addition, FIG. 1 further shows a liquid container 40 that is used as attachment to the liquid detecting apparatus 10 according to the first embodiment of the invention. In the configuration of a liquid detecting system according to the present embodiment of the invention, the liquid container 40 is configured as a discrete attachment unit that is separated from the liquid detecting apparatus 10. Or, in other words, the liquid detecting apparatus 10 is configured as a discrete main unit that is separated from the liquid container 40. The liquid container 40 is attached to the liquid detecting apparatus 10 in a detachable manner.

Configuration of Liquid Container

In order to facilitate the understanding of unique and characteristic features of the invention, in the following description, the configuration of the liquid container 40 is explained first, which will be followed by an explanation of the unique and characteristic configuration of the liquid detecting apparatus 10. The liquid container 40 is provided with a liquid detecting unit (i.e., liquid detecting portion) 41, a liquid containing unit (i.e., liquid containing portion) 42, a first terminal 46, and a second terminal 47. The liquid detecting unit 41 detects whether a certain amount of liquid is contained in the liquid containing unit 42 or not. Or, more specifically, the liquid detecting unit 41 detects whether the amount of liquid contained in the liquid containing unit 42 is larger than, or, at the smallest, equals to, a predetermined threshold amount or not. The liquid detecting unit 41 of the liquid container 40 according to the present embodiment of the invention is made up of a first electrode 41*a*, a second electrode 41*b*, and a piezoelectric element 41*c*. The piezoelectric element 41*c* is interposed between the first electrode 41*a* and the second electrode 41*b*. The piezoelectric element 41*c* functions as a liquid detection sensor. Notwithstanding the above, however, the liquid detection sensor of the liquid detecting unit 41 may be embodied by means of an alternative device, element, part, or the like other than the piezoelectric element 41*c*. That is, as a substitute for the piezoelectric element 41*c*, any electromechanical energy transducer that outputs two antiphase detection signals that have phases opposite to each other to these first and second electrodes 41*a* and 41*b* (e.g., any electro-mechanical energy transducer that outputs one detection signal to the first electrode 41*a* and further outputs another detection signal that has a phase opposite to that of the above-mentioned one detection signal to the second electrode 41*b*) may be adopted as the liquid detection sensor of the liquid detecting unit 41.

The first electrode 41*a* of the liquid detecting unit 41 is electrically connected to a first terminal 46, whereas the second electrode 41*b* of the liquid detecting unit 41 is electrically connected to a second terminal 47. When a voltage is applied to the piezoelectric element 41*c* via the first terminal 46 and the first electrode 41*a*, the voltage-applied piezoelectric element 41*c* becomes deformed due to inverse piezoelectric effect. When the first terminal 46 is released so as to discontinue the application of a voltage thereto, an electric charge that has been accumulated in the voltage-applied (and thus deformed) piezoelectric element 41*c* is discharged therefrom. As a result thereof, the piezoelectric element 41*c* vibrates at the eigenfrequency (resonance frequency) of a line that includes the liquid detecting unit 41. It should be noted that the term "eigenfrequency" means a natural vibration frequency herein. Because liquid constitutes a part of the "line" that includes the liquid detecting unit 41, the eigenfrequency (i.e., natural vibration frequency) of the line varies depending on the presence or absence of liquid therein.

The piezoelectric element 41*c* outputs counter-electromotive voltage signals (i.e., detection signals) that are generated as a result of the vibration thereof. The counter-electromotive voltage signals that are output through the first and second electrodes 41*a* and 41*b* of the liquid detecting unit 41 (piezoelectric element 41*c*) have phases opposite to each other (antiphase signals). On the other hand, exogenous noise that interferes with or affects the outputs of the liquid detecting unit 41 as external noise coming from an outside source is superimposed on the detection signals (i.e., above-mentioned outputs) that are output through the first and second electrodes 41*a* and 41*b* thereof as common mode noise having the same phase (equiphase or in-phase) with respect thereto.

Configuration of Liquid Detecting Apparatus

The liquid detecting apparatus 10 according to the first embodiment of the invention is provided with, as the main components thereof, a driving unit 11, a signal detection unit 12, a control unit 20, a differential amplification unit 30, a high-pass filtering unit 35, a first switch SW1, a second switch SW2, a first apparatus-side terminal 13, and a second apparatus-side terminal 14.

The driving unit 11 is connected to the first apparatus-side terminal 13 via a first signal line L1. The first switch SW1, which electrically connects the driving unit 11 and the first apparatus-side terminal 13 or electrically disconnects the driving unit 11 from the first apparatus-side terminal 13, is provided on the first signal line L1. The ground 15 is connected to the second apparatus-side terminal 14 via a second signal line L2. The second switch SW2, which electrically connects the ground 15 and the second apparatus-side terminal 14 or electrically disconnects the ground 15 from the second apparatus-side terminal 14, is provided on the second signal line L2.

A first input terminal 35*a* of the high-pass filtering unit 35 is connected to, via a first detection signal line L11, a connection point provided between the first switch SW1 and the first apparatus-side terminal 13 on the first signal line L1. A second input terminal 35*b* of the high-pass filtering unit 35 is connected to, via a second detection signal line L21, a connection point provided between the second switch SW2 and the second apparatus-side terminal 14 on the second signal line L2. Various kinds of switching circuits including but not limited to a variety of transistors can be used as the first switch SW1 and the second switch SW2.

The differential amplification unit 30 is connected to the output-side terminals of the high-pass filtering unit 35. Specifically, a first output terminal 35*c* of the high-pass filtering unit 35 is connected to a first input terminal 30*a* of the differential amplification unit 30, whereas a second output terminal 35*d* of the high-pass filtering unit 35 is connected to a second input terminal 30*b* of the differential amplification unit 30.

The signal detection unit 12 is connected to the output terminal of the differential amplification unit 30 via a third signal line L3.

The driving unit 11 applies a driving signal, which has a predetermined driving-signal waveform, to the liquid detecting unit 41 provided in the liquid container 40. The generation of a driving signal is performed as follows. Needless to say, it should be noted that the following is a non-limiting example of the method of generating a driving signal. The driving unit 11 has stored driving-signal waveform data in advance as pre-stored data. The driving unit 11 reads out the pre-stored driving-signal waveform data and performs digital-to-analog (D/A) conversion thereon. After the D/A conversion of the pre-stored driving-signal waveform data, the driving unit 11 performs (mathematical) integration on the D/A converted data. As a result thereof, a driving signal that has a predetermined driving waveform is generated. The driving unit 11 drives the liquid detecting unit 41 by means of a driving waveform that corresponds to a vibration frequency (i.e., oscillation frequency) that is equivalent to the eigenfrequency (i.e., natural vibration frequency) that is obtained under the conditions that the amount of liquid contained in the liquid containing unit 42 of the liquid container 40 is larger than a predetermined threshold amount, or, by means of a driving waveform that corresponds to the natural vibration frequency that is obtained under the conditions that the amount of liquid contained in the liquid containing unit 42 of the liquid container 40 is smaller than the predetermined threshold amount. Or, in other words, the driving unit 11 drives the liquid detecting unit 41 by means of a driving waveform that corresponds to a vibration frequency that is equivalent to the natural vibration frequency that is obtained under the conditions that a certain amount of liquid is contained in the line that includes the liquid detecting unit 41, or, by means of a driving waveform that corresponds to the natural vibration frequency that is obtained under the conditions that a certain amount of liquid is not contained in the line that includes the liquid detecting unit 41.

The signal detection unit 12 detects, or, in other words, judges, whether a certain amount of liquid is contained in the liquid containing unit 42 of the liquid container 40 or not by means of a differential amplification detection signal that has been input from the differential amplification unit 30 into the signal detection unit 12. Specifically, the signal detection unit 12 detects (i.e., judges) whether a certain amount of liquid is contained in the liquid containing unit 42 of the liquid container 40 or not on the basis of the measurement result of the vibration frequency of the differential amplification detection signal that has been input from the differential amplification unit 30 into the signal detection unit 12. The vibration frequency of the differential amplification detection signal indicates the natural vibration frequency of a peripheral structure (s) and a peripheral object(s) that surround the liquid detecting unit 41 and thus vibrate together with the liquid detecting unit 41. Examples of such a peripheral structure(s) and a peripheral object(s) include a case and liquid (e.g., ink). The vibration frequency of the differential amplification detection signal changes in accordance with the amount of liquid remaining in the liquid containing unit 42. As the vibration frequency of the differential amplification detection signal changes in accordance with the amount of liquid remaining in the liquid containing unit 42, it is possible to makes a judgment as to whether a sufficient amount of liquid is contained in the liquid containing unit 42 or not on the basis of whether a differential amplification detection signal that has a vibration frequency used for detection has been measured or not from the liquid detecting unit 41 that was driven by means of the above-described driving signal.

The high-pass filtering unit 35 removes low-frequency components/direct-current components that are contained in detection signals. Since the high-pass filtering unit 35 removes direct-current components that are contained in detection signals, it is possible to use an amplifying circuit that has a low breakdown voltage as the differential amplification unit 30. In the configuration of the liquid container 40 described in the present embodiment of the invention, the piezoelectric element 41*c*, which is a ferroelectric substance, is used in the liquid detecting unit 41 thereof. When a ferroelectric substance such as the piezoelectric element 41*c* is used in the liquid detecting unit 41 as in the configuration of the liquid container 40 described in the present embodiment of the invention, the subsonic vibration, or, in other words, low-frequency oscillation, of a voltage occurs. Although it is not impossible to remove the low-frequency oscillation of a voltage as a result of differential amplification because it has antiphase similar to the aforementioned antiphase nature of detection signals, in the configuration of the liquid detecting apparatus 10 according to the present embodiment of the invention, the high-pass filtering unit 35 removes the low-frequency oscillation of a voltage. Consequently, it is possible to improve the measurement accuracy of detection signals.

The high-pass filtering unit 35 has an RC filter circuit that is made up of a first capacitor C1 and a first resistor R1 that is provided in electric connection with the first detection signal line L11. In addition thereto, the high-pass filtering unit 35 further has another RC filter circuit that is made up of a second capacitor C2 and a second resistor R2 that is provided in electric connection with the second detection signal line L21. A reference potential, or, in other words, a reference voltage, which is denoted as Vref, is applied to each of these RC filter circuits. The reference voltage Vref is a potential on which detection signals converge.

The differential amplification unit 30 amplifies detection signals by means of a difference between one detection signal that is output from the first output terminal 35*c* of the high-pass filtering unit 35 and then input into the first input terminal 30*a* of the differential amplification unit 30 and another detection signal that is output from the second output terminal 35*d* of the high-pass filtering unit 35 and then input into the second input terminal 30*b* of the differential amplification unit 30, thereby generating a amplification detection signal. As has already been described earlier, in the configuration of the liquid detecting unit 41 that is used in the present embodiment of the invention, the piezoelectric element 41*c* is used as a liquid detection sensor. Therefore, detection signals that are output from the piezoelectric element 41*c* have phases opposite to each other. Therefore, it is possible to amplify the amplitude (i.e., electric potential, or, in other words, voltage) of detection signals through the functioning of the differential amplification unit 30, while reducing, suppressing, or completely canceling and rejecting the adverse effects of any exogenous noise that is superimposed on the detection signals as in-phase common mode noise. A well-known differential amplification circuit can be used as the differential amplification unit 30.

The control unit 20 is connected to the driving unit 11, the signal detection unit 12, the first switch SW1, and the second switch SW2 via control signal lines. As illustrated in FIG. 2, the control unit 20 is provided with a central processing unit (CPU) 21, a memory 22, and an input/output interface 23. The CPU 21 executes arithmetic operation. The memory 22 stores the result of arithmetic operation and a liquid detection processing execution program, though not limited thereto. The input/output interface 23 provides an I/O interface so as to electrically connect the internal units of the control unit 20, which include, the CPU 21 and the memory 22, to external circuits (i.e., the driving unit 11 and the signal detection unit 12) and switches (i.e., the first switch SW1 and the second switch SW2). The CPU 21, the memory 22, and the I/O interface 23 are interconnected to one another via an internal bus 24.

The memory 22 stores a detection execution module M1 and a judgment module M2 each of which is executed by the CPU 21. The detection execution module M1 stored in the memory 22 commands the driving unit 11 to output a driving signal and sets each of the first switch SW1 and the second switch SW2 into an ON state so as to electrically connect the driving unit 11 to the liquid detecting unit 41. The judgment module M2 stored in the memory 22 commands the signal detection unit 12 to make a judgment on the presence/absence of a certain amount of liquid and sets each of the first switch SW1 and the second switch SW2 into an OFF state so as to electrically disconnect the driving unit 11 from the liquid detecting unit 41.

In the following description, the procedure of liquid detection processing is explained. The control unit 20 executes the detection execution module M1 so as to turn each of the first switch SW1 and the second switch SW2 into an ON state. With the first and second switches SW1 and SW2 being set ON, the driving unit 11 applies a driving signal to the liquid detecting unit 41 via the first apparatus-side terminal 13 and the first terminal 46. As a result of the application of a driving signal, the piezoelectric element 41*c* becomes deformed due to electrostrictive effect. Then, after a certain length of time period has elapsed, the control unit 20 executes the judgment module M2 so as to turn each of the first switch SW1 and the second switch SW2 into an OFF state. As a result of the setting of each of the first and second switches SW1 and SW2 into an OFF state, the piezoelectric element 41*c* vibrates at the natural vibration frequency of the line that includes the liquid detecting unit 41. Then, a signal having the waveform of a counter-electromotive voltage, that is, a detection signal is output from each of the first electrode 41*a* and the second electrode 41*b* of the liquid detecting unit 41. One counter-electromotive detection signal that is output from the first electrode 41*a* of the liquid detecting unit 41 and the other counter-electromotive detection signal that is output from the second electrode 41*b* of the liquid detecting unit 41 have phases opposite to each other. Each of the above-mentioned one detection signal that is output from the first electrode 41*a* of the liquid detecting unit 41 and the above-mentioned other detection signal that is output from the second electrode 41*b* of the liquid detecting unit 41 is then input into the high-pass filtering unit 35. At the high-pass filtering unit 35, direct-current components/low-frequency components that are contained in these detection signals are reduced or removed.

After the reduction or removal of low-frequency components/direct-current components performed at the high-pass filtering unit 35, each of these detection signals is input into the differential amplification unit 30. As its name suggests, the differential amplification unit 30 performs differential amplification on the basis of a difference between these detection signals. As a result of differential amplification, a differential amplification detection signal is obtained, where the differential amplification detection signal features reduced or removed equiphase (i.e., in-phase, same-phase) exogenous noise, which was superimposed on these detection signals before the reduction or removal thereof. The differential amplification detection signal is input into the signal detection unit 12. The signal detection unit 12 makes a judgment as to whether the input differential amplification detection signal agrees with a predetermined natural vibration frequency (resonance frequency) or not. If the differential amplification detection signal agrees with a predetermined natural vibration frequency, the signal detection unit 12 judges that the amount of liquid contained in the liquid containing unit 42 of the liquid container 40 is larger than, or, at the smallest, equals to, a predetermined threshold amount (or, in other words, a predetermined amount, or larger, of liquid is present in the liquid container 40). On the other hand, if the differential amplification detection signal disagrees with a predetermined natural vibration frequency, the signal detection unit 12 judges that the amount of liquid contained in the liquid containing unit 42 of the liquid container 40 is smaller than a predetermined threshold amount (or, in other words, a predetermined amount, or larger, of liquid is absent in the liquid container 40).

In the foregoing description, "the first switch SW1 is set into an ON state" means that the driving unit 11 and the liquid detecting unit 41, or more specifically, the driving unit 11 and the first electrode 41*a* of the liquid detecting unit 41, are electrically connected to each other, whereas "the second switch SW2 is set into an ON state" means that the ground 15 and the liquid detecting unit 41, or more specifically, the ground 15 and the second electrode 41*b* of the liquid detecting unit 41, are electrically connected to each other. On the other hand, in the foregoing description, "the first switch SW1 is set into an OFF state" means that the driving unit 11 and the liquid detecting unit 41, or more specifically, the driving unit 11 and the first electrode 41*a* of the liquid detecting unit 41, are electrically disconnected from each other, whereas "the second switch SW2 is set into an OFF state" means that the ground 15 and the liquid detecting unit 41, or more specifically, the ground 15 and the second electrode 41*b* of the liquid detecting unit 41, are electrically disconnected from each other.

Figure 3:
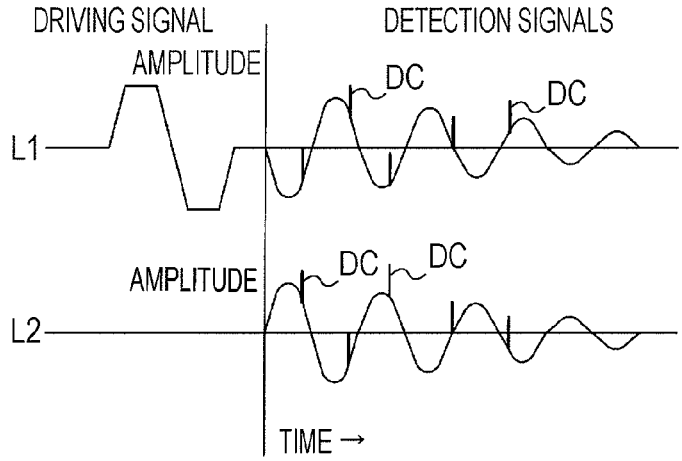
FIG. 3 is an explanatory diagram that schematically illustrates an example of a driving signal that is input into a liquid detecting unit that is used in the first embodiment of the invention and further illustrates an example of detection signals that are output from the liquid detecting unit that is used in the first embodiment of the invention.
Figure 4:
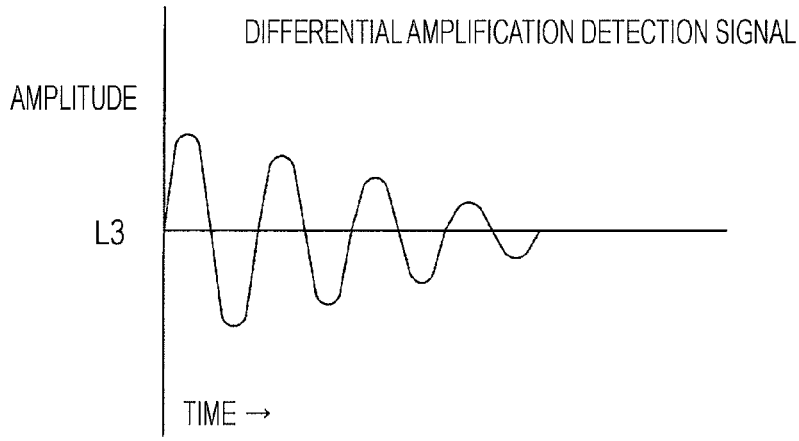
FIG. 4 is an explanatory diagram that schematically illustrates an example of a differential amplification detection signal that is used for making a judgment on the presence/absence of liquid in a liquid detecting apparatus according to the first embodiment of the invention.
Figure 5:
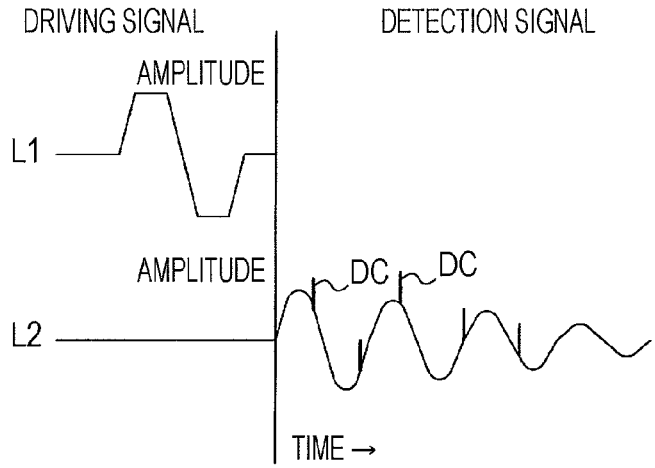
FIG. 5 is an explanatory diagram that schematically illustrates an example of a detection signal that is output from a liquid detecting apparatus according to prior art.

In the following description, an example of advantageous effects offered by the liquid detecting apparatus 10 according to the first embodiment of the invention is explained while making reference to FIGS. 3, 4, and 5. FIG. 3 is an explanatory diagram that schematically illustrates an example of a driving signal that is input into a liquid detecting unit that is used in the first embodiment of the invention and further illustrates an example of detection signals that are output from the liquid detecting unit that is used in the first embodiment of the invention. FIG. 4 is an explanatory diagram that schematically illustrates an example of a differential amplification detection signal that is used for making a judgment on the presence/absence of liquid in a liquid detecting apparatus according to the first embodiment of the invention. FIG. 5 is an explanatory diagram that schematically illustrates an example of a detection signal that is output from a liquid detecting apparatus according to prior art.

When the first switch SW1 (and the second switch SW2) is set ON, a driving signal that is output on the first signal line L1 is supplied to the liquid detecting unit 41. By this means, a pulse waveform voltage is applied to the piezoelectric element 41*c*. After a certain length of time period has elapsed, each of the first switch SW1 and the second switch SW2 is set into an OFF state. As a result thereof, two antiphase detection signals shown in FIG. 3, one of which has a phase opposite to the other thereof, are output on the first signal line L1 and the second signal line L2, respectively. Exogenous noise that is denoted as DC in the accompanying drawings is superimposed on these detection signals as common mode noise having the same phase (equiphase or in-phase) with respect thereto.

Each of the above-mentioned one detection signal that is output on the first signal line L1 and the above-mentioned other detection signal that is output on the second signal line L2 enters the high-pass filtering unit 35. Thereafter, these signals are input from the high-pass filtering unit 35 into the differential amplification unit 30. As has already been described earlier, direct-current components/low-frequency components that are contained in these detection signals are removed at the high-pass filtering unit 35. A differential amplification detection signal, an example of which is illustrated in FIG. 4, is output onto the third signal line L3 from the differential amplification unit 30. As a result of differential amplification performed at the differential amplification unit 30, equiphase exogenous noise components are reduced, suppressed, or completely canceled and rejected whereas antiphase detection-signal components are amplified. By this means, it is possible to enhance the judgment precision of the signal detection unit 12.

In contrast, as illustrated in FIG. 5, a liquid detecting apparatus of the related art performs a judgment by means of a single detection signal that is output from a liquid detecting unit thereof. Since such a configuration is vulnerable to exogenous noise components, judgment precision offered by a liquid detecting apparatus of the related art is relatively low in comparison with that offered by the liquid detecting apparatus 10 according to the first embodiment of the invention.

As explained above, since the liquid detecting apparatus 10 according to the first embodiment of the invention is provided with the differential amplification unit 30, it is possible to reduce, suppress, or completely cancel and reject any exogenous noise that is superimposed on detection signals as equiphase (i.e., in-phase, same-phase) common mode noise. As a result thereof, on the basis of a differential amplification detection signal output from the differential amplification unit 30 that features reduced or removed equiphase exogenous noise, it is possible to improve precision in judgment performed by the signal detection unit 12. In the foregoing description of the first embodiment of the invention, it is explained that, in order to simplify explanation, the liquid detecting apparatus 10 is provided with both of the differential amplification unit 30 and the high-pass filtering unit 35. However, the scope of the invention is not limited to such an exemplary configuration. For example, the same advantageous effects as those described above can be obtained even when the liquid detecting apparatus 10 is not provided with the high-pass filtering unit 35.

Since the liquid detecting apparatus 10 according to the first embodiment of the invention described above is provided with the high-pass filtering unit 35, it is possible to reduce or remove low-frequency components/direct-current components that are contained in detection signals (before reduction or removal thereof). This makes it further possible to use an amplifying circuit that has a low breakdown voltage as the differential amplification unit 30, which contributes to the reduction of production cost or the increased reliability of products. Moreover, since the liquid detecting apparatus 10 according to the first embodiment of the invention described above is provided with the high-pass filtering unit 35, it is possible to remove the subsonic-vibration components, or, in other words, low-frequency-oscillation components, of a voltage that are generated by the piezoelectric element 41*c*, which is a ferroelectric substance used in the liquid detecting unit 41. Consequently, it is possible to further improve the measurement accuracy of detection signals.

Second Embodiment

Figure 6:
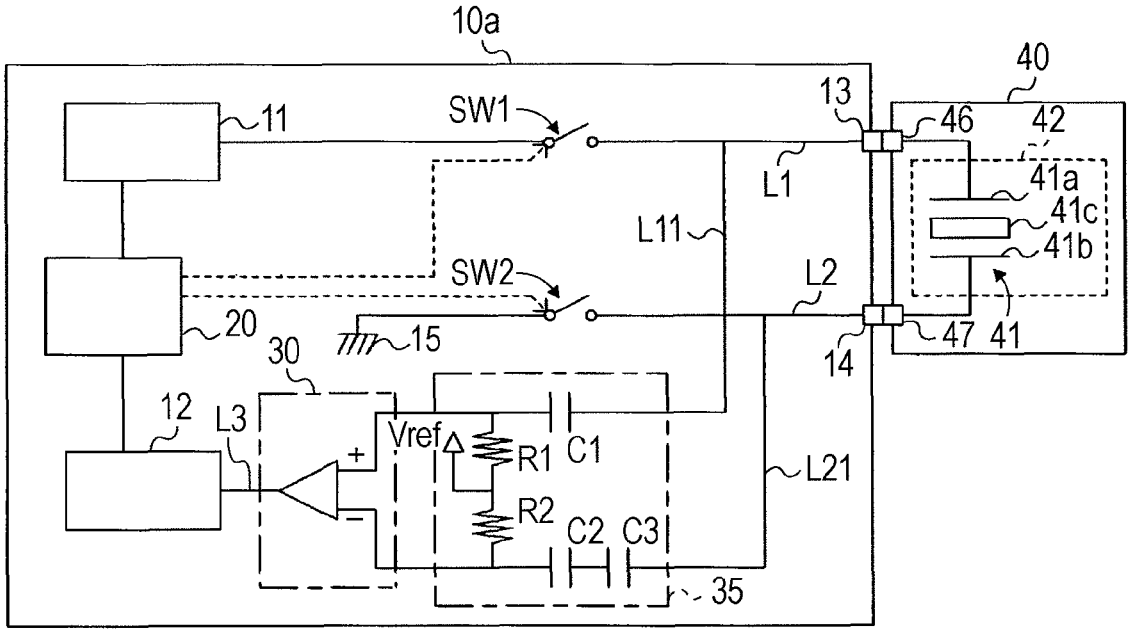
FIG. 6 is an explanatory diagram that schematically illustrates an example of the inner configuration of a liquid detecting apparatus according to a second embodiment of the invention.
Figure 7:
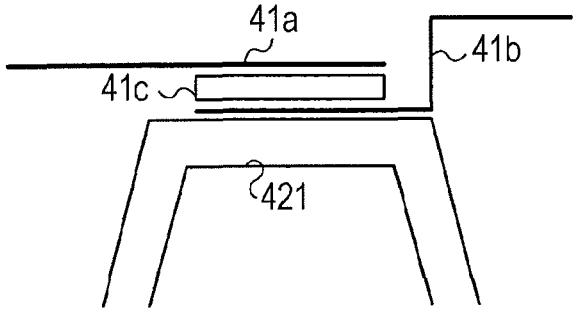
FIG. 7 is an explanatory diagram that schematically illustrates an example of the configuration of a liquid detecting unit.

Next, in the following description, an example of the configuration of a liquid detecting apparatus 10*a* according to a second embodiment of the invention is explained while making reference to FIGS. 6 and 7. FIG. 6 is an explanatory diagram that schematically illustrates an example of the inner configuration of the liquid detecting apparatus 10*a* according to the second embodiment of the invention. FIG. 7 is an explanatory diagram that schematically illustrates an example of the configuration of the liquid detecting unit 41.

The configuration of the liquid detecting apparatus 10*a* according to the second embodiment of the invention described below differs from the configuration of the liquid detecting apparatus 10 according to the first embodiment of the invention described above in that the liquid detecting apparatus 10*a* according to the second embodiment of the invention is provided with a high-pass filtering unit 35*a* that is further provided with a third capacitor C3. It should be noted that the same reference numerals are assigned to the same components, among all components that appear in the following description of the liquid detecting apparatus 10*a* according to the second embodiment of the invention, as those of the liquid detecting apparatus 10 according to the first embodiment of the invention described above; and a detailed explanation thereof is omitted, or an explanation is simplified as long as the understanding of the unique feature of the invention is not impaired.

As illustrated in FIG. 7, the second electrode 41*b* of the liquid detecting unit 41 is provided in the proximity of a liquid flow channel 421. For this reason, in comparison with the first electrode 41*a* of the liquid detecting unit 41, the second electrode 41*b* thereof is more susceptible to exogenous noise. Specifically, since liquid, which is an electric conduction medium, acts as a noise source, the second electrode 41*b* of the liquid detecting unit 41, which is provided at a position closer to liquid flow channel 421, that is, the noise source, is more susceptible to exogenous noise (alternating-current components) than the first electrode 41*a* thereof.

In order to provide a technical solution to the greater exogenous-noise susceptibility of the second electrode 41*b* of the liquid detecting unit 41, the liquid detecting apparatus 10*a* according to the second embodiment of the invention has the third capacitor C3, which is provided in one of the RC filter circuits that is electrically connected to the second detection signal line L21 on which a detection signal output from the second electrode 41*b* flows. The capacitance of the third capacitor C3 is substantially the same as that of the piezoelectric element 41*c*. With such a configuration, it is possible to reduce, suppress, or completely cancel and reject any noise that is attributable to the liquid detecting unit 41 (or more specifically, the piezoelectric element 41*c*), which is a capacitive sensor.

As another non-limiting example of technical solutions/measures that can be adopted in order to address the problem of a difference, if any, in an exogenous noise that arises at the first electrode 41*a* of the piezoelectric element 41*c* (liquid detecting unit 41) and an exogenous noise that arises at the second electrode 41*b* of the piezoelectric element 41*c*, in addition to the above-described differentiation (i.e., provisioning of a difference) of filtering characteristics between one RC filter circuit into which one detection signal that is output from the first electrode 41*a* is input and the other RC filter circuit into which the other detection signal that is output from the second electrode 41*a* is input, different gains may be applied in the differential amplification unit 30 to these detection signals output from the first electrode 41*a* of the piezoelectric element 41*c* and the second electrode 41*b* of the piezoelectric element 41*c*, respectively. Whichever of these technical solutions/measures described above is taken, it is possible to reduce, suppress, or completely cancel and reject any noise contained in a detection signal output from an electrode that is more susceptible to exogenous noise.

Figure 8:
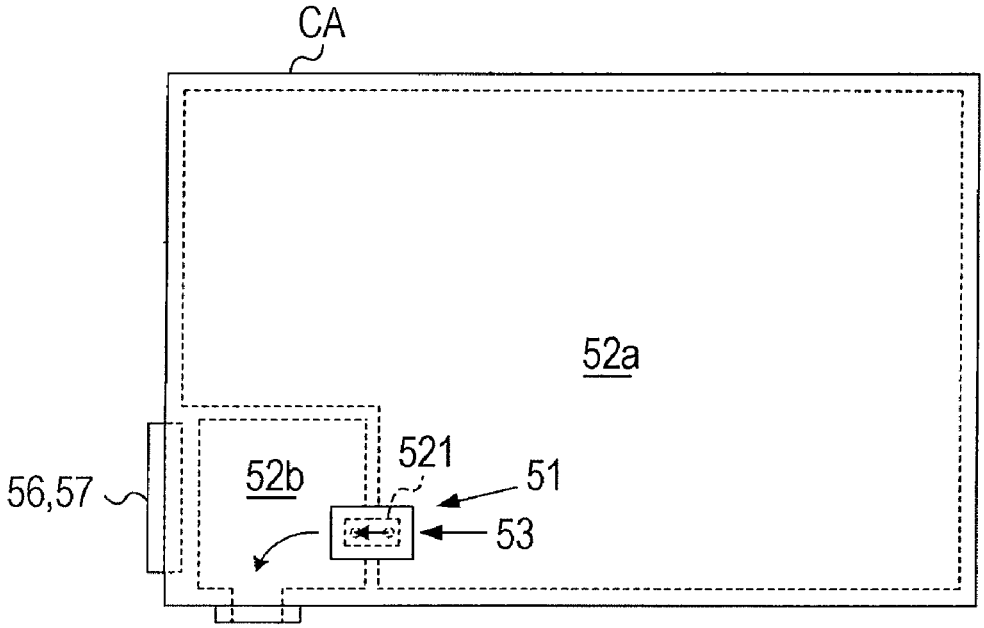
FIG. 8 is a side view that schematically illustrates an example of the configuration of an ink cartridge, which is an example of a liquid container that is used as attachment to a liquid detecting apparatus according to the first embodiment of the invention or a liquid detecting apparatus according to the second embodiment of the invention.
Figure 9:
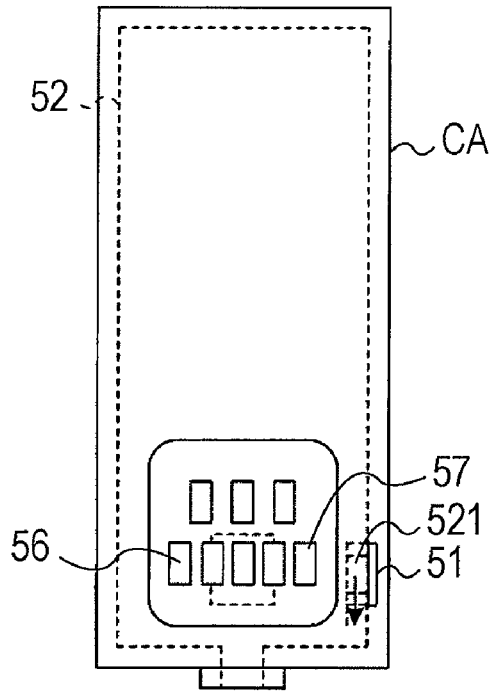
FIG. 9 is a front view that schematically illustrates an example of the configuration of an ink cartridge, which is an example of a liquid container that is used as attachment to a liquid detecting apparatus according to the first embodiment of the invention or a liquid detecting apparatus according to the second embodiment of the invention.
Figure 10:
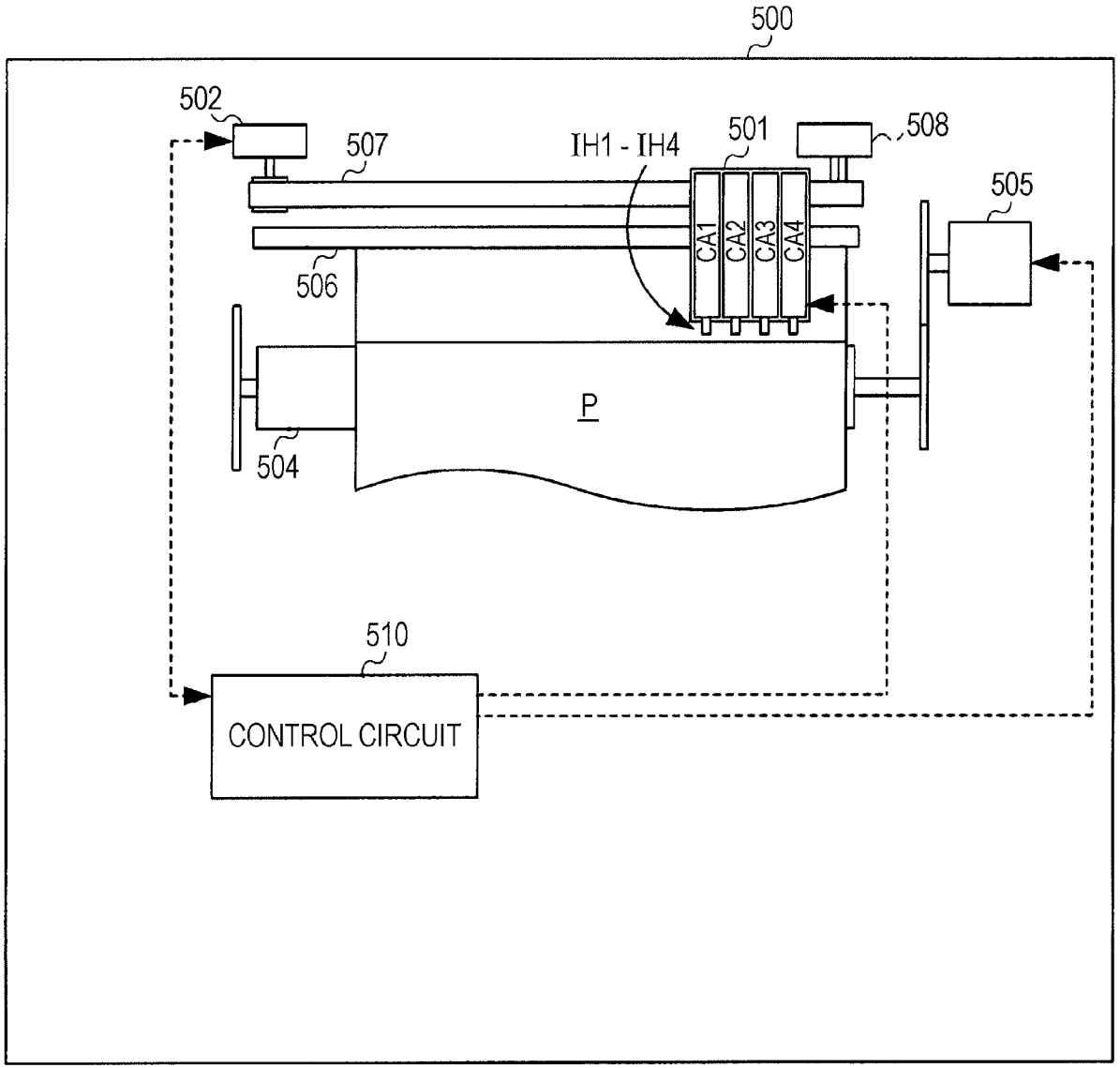
FIG. 10 is an explanatory diagram that schematically illustrates an example of the mechanical/functional control configuration of a printing apparatus, which is an example of a liquid detecting apparatus according to the first embodiment of the invention or a liquid detecting apparatus according to the second embodiment of the invention.

Next, in the following description, an application example of the liquid detecting apparatus 10 according to the first embodiment of the invention or the liquid detecting apparatus 10*a* according to the second embodiment of the invention and the liquid container 40 that is used in conjunction therewith are explained while making reference to FIGS. 8, 9, and 10. FIG. 8 is a side view that schematically illustrates an example of the configuration of an ink cartridge, which is an example of the liquid container 40 that is used as attachment to the liquid detecting apparatus 10 according to the first embodiment of the invention or the liquid detecting apparatus 10*a* according to the second embodiment of the invention. FIG. 9 is a front view that schematically illustrates an example of the configuration of an ink cartridge, which is an example of the liquid container 40 that is used as attachment to the liquid detecting apparatus 10 according to the first embodiment of the invention or the liquid detecting apparatus 10*a* according to the second embodiment of the invention. FIG. 10 is an explanatory diagram that schematically illustrates an example of the mechanical/functional control configuration of a printing apparatus, which is an example of the liquid detecting apparatus 10 according to the first embodiment of the invention or the liquid detecting apparatus 10*a* according to the second embodiment of the invention.

As illustrated in dotted lines in FIGS. 8 and 9, an ink cartridge CA, which is an application example of the liquid container 40 that is used as attachment to the liquid detecting apparatus 10 according to the first embodiment of the invention or the liquid detecting apparatus 10*a* according to the second embodiment of the invention, is provided with a detecting unit (i.e., detecting portion) 51, a first ink-containing unit (i.e., a first ink-containing portion) 52*a*, and a second ink-containing unit (i.e., a second ink-containing portion) 52*b*. The detecting unit 51 is an application example of the aforementioned the liquid detecting unit 41.

The detecting unit 51 is provided on a side surface of the ink cartridge CA. A communication path 521 that communicates the first ink-containing portion (e.g., main ink containing portion) 52*a* with the second ink-containing portion (e.g., sub ink-containing portion) 52*b* is provided in the ink cartridge CA. The detecting unit 51 is provided with an ink-remaining-amount detection sensor (e.g., piezoelectric element) 53. The ink-remaining-amount detection sensor 53 of the detecting unit 51 detects whether the communication path 521 is filled with ink (that is, ink is present in the communication path 521) or the communication path 521 is not filled with ink (that is, ink is absent in the communication path 521). As a result of the detection made on the presence/absence of ink in the communication path 521, that is, as to whether the communication path 521 is filled with ink or not, the detecting unit 51 judges (i.e., detects) whether the amount of ink remaining in the ink cartridge CA is smaller than a predetermined threshold amount or not.

The communication path 521 is structured as a narrow passage that is capable of causing capillary action, thereby reducing the risk of, or avoiding, the infiltration of any air bubble that has entered into the first ink-containing portion 52*a* or the second ink-containing portion 52*b* into the communication path 521. With such a configuration, it is possible to reduce the risk of, or avoid, any erroneous detection of an "ink end" status by the ink-remaining-amount detection sensor 53 due to any air bubble that could be present in the proximity of the ink-remaining-amount detection sensor 53 even though there is still ample amount of ink remaining in the first ink-containing portion 52*a*. On the other hand, since a large amount of air bubbles enters into the communication path 521 at the time when ink runs out of the first ink-containing portion 52*a*, the ink-remaining-amount detection sensor 53 detects an ink-end status when the first ink-containing portion 52*a* becomes empty as it is supposed to do so.

When ink is present in the first ink-containing portion 52*a*, the communication path 521 is filled with ink. On the other hand, when ink is absent in the first ink-containing portion 52*a*, or, to be more exact, when ink is not present in the first ink-containing portion 52*a* but present in the second ink-containing portion 52*b*, the communication path 521 is not filled with ink. Accordingly, it can be said in an application example of the foregoing exemplary embodiments of the invention described herein that the aforementioned predetermined threshold amount is the ink capacity of the second ink-containing portion 52*b*. Moreover, it can be said in an application example of the foregoing exemplary embodiments of the invention described herein that the empty state of an ink-containing portion is a state where the communication path 521 is not filled with ink.

The ink-remaining-amount detection sensor 53 may be provided in such a manner that it contacts ink directly; or alternatively, it may be provided in indirect contact with ink in such a manner that a member for improving detection characteristics thereof, for example, is interposed therebetween.

As illustrated in FIG. 10, a printing apparatus 500 is provided with a control circuit 510 and a printing unit. The printing unit of the printing apparatus 500 is provided with a head-driving mechanism, a main-scan feed mechanism, and a sub-scan feed mechanism. The head-driving mechanism drives print heads IH1, IH2, IH3, and IH4 that are mounted on a carriage 501 to discharge ink drops onto a print target medium such as a sheet of printing paper P so as to generate a desired dot pattern thereon. The main-scan feed mechanism reciprocates the carriage 501 by means of a carriage motor 502 in the axial direction (i.e., main-scan direction) of a platen 504. The sub-scan feed mechanism transports the printing paper P by means of a paper-feed motor 505. The main-scan feed mechanism that reciprocates the carriage 501 along the axial direction of the platen 504 is made up of, though not limited thereto, a sliding axis 506 that is provided in parallel with the axis of the platen 504 and supports the carriage 501 so that the carriage 501 can move in a sliding manner thereon, a pulley 508 that stretches a driving belt 507 having no ends (i.e., endless driving belt) between the carriage motor 502 and the pulley 508 itself, and a position detection sensor that detects the home position (i.e., origin) of the carriage 501. It should be noted that the position detection sensor is not illustrated in the drawing. The sub-scan feed mechanism that transports the printing paper P is made up of, though not necessarily limited thereto, the platen 504, the paper-feed motor 505 that rotates the platen 504, a paper-feed auxiliary roller, and a gear train that communicates the rotational force of the paper-feed motor 505 to the platen 504 and the paper-feed auxiliary roller. It should be noted that the paper-feed auxiliary roller and the gear train are not illustrated in the drawing.

The carriage 501 is provided with an ink-cartridge attachment unit to which each of ink cartridges CA1, CA2, CA3, and CA4 is attached. Black (K) ink is contained in the ink cartridge CA1. Cyan (C) ink is contained in the ink cartridge CA2. Magenta (M) ink is contained in the ink cartridge CA3. Yellow (Y) ink is contained in the ink cartridge CA4. In addition to the above-described four ink cartridges CA1, CA2, CA3, and CA4, which correspond to ink colors of K, C, M, and Y, respectively, additional ink cartridges that correspond to additional ink colors of light cyan (LC), light magenta (LM), dark yellow (DY), light black (LB), red (R), and blue (B) may be attached to the ink-cartridge attachment unit of the carriage 501.

Each individual ink-cartridge attachment region of the carriage 501 to which the corresponding one of these ink cartridges CA is attached is provided with the above-explained apparatus-side external terminals. As these apparatus-side external terminals of the individual ink-cartridge attachment region of the carriage 501 becomes in mechanical and electrical contact with the aforementioned first terminal 46 and the second terminal 47, the control circuit 510 can apply a driving signal to the detecting unit 51 so as to obtain detection signals.

The control circuit 510 executes print processing and ink-remaining-amount detection processing that are performed in the printing apparatus 500. As the aforementioned control unit 20 according to the foregoing exemplary embodiment of the invention is provided with the CPU 21, the memory 22, and the I/O interface 23, and the internal bus 24, the control circuit 510 according to a non-limiting application example thereof described herein is provided with a central processing unit (CPU), a memory, an input/output (I/O) interface, and an internal bus, each of which is not illustrated in the drawing.

Figure 11:
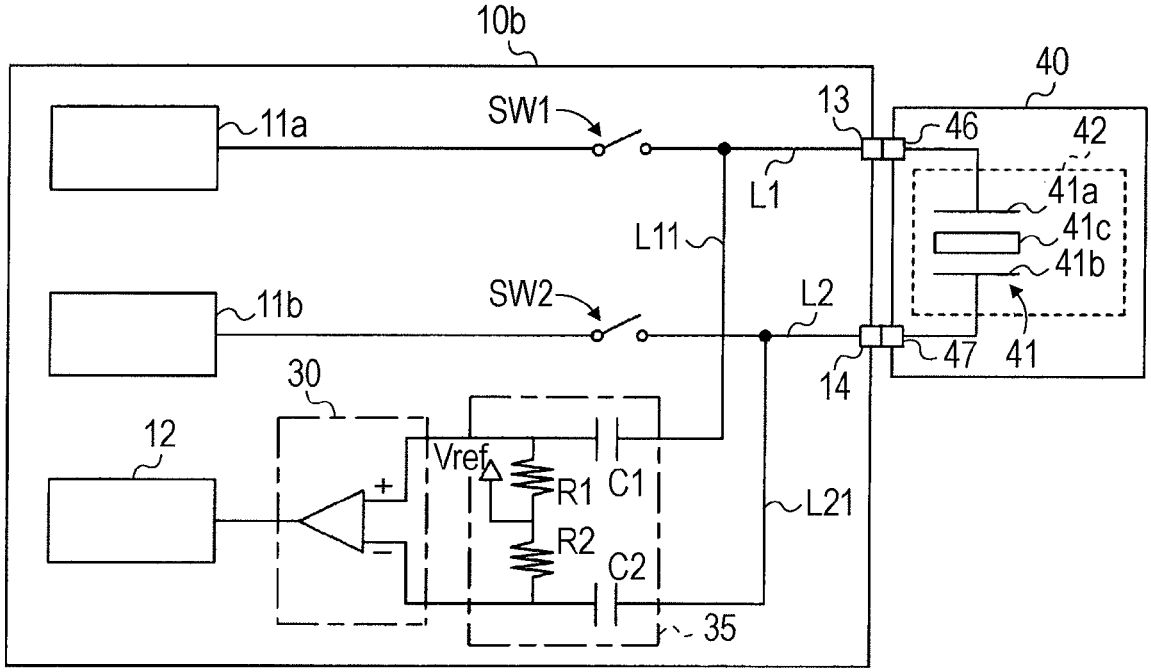
FIG. 11 is an explanatory diagram that schematically illustrates an example of the inner configuration of a liquid detecting apparatus according to another exemplary embodiment of the invention.

Other Embodiments (1) In each of the foregoing exemplary embodiments of the invention, it is explained that the liquid detecting apparatus 10 (10*a*) has only one driving unit 11. However, the scope of the invention is not limited to such an exemplary configuration. As a non-limiting modification example thereof, the invention can be embodied by means of a liquid detecting apparatus that has two driving units. Specifically, a liquid detecting apparatus 10*b* illustrated in FIG. 11 is provided with a first driving unit 11*a* that corresponds to the first electrode 41*a* of the liquid detecting unit 41 and a second driving unit 11*b* that corresponds to the second electrode 41*b* thereof. FIG. 11 is an explanatory diagram that schematically illustrates an example of the inner configuration of a liquid detecting apparatus according to another exemplary embodiment of the invention.

When the configuration of the liquid detecting apparatus 10*b* having the first driving unit 11*a* and the second driving unit 11*b* is adopted, liquid detecting operation thereof is performed as follows. A control unit that is not shown in the drawing commands each of the first driving unit 11*a* and the second driving unit 11*b* to output a driving signal. Each of the first switch SW1 and the second switch SW2 is set ON. With each of these switches being set ON, the first driving unit 11*a* applies a driving signal to the liquid detecting unit 41 via the first switch SW1 whereas the second driving unit 11*b* applies a driving signal to the liquid detecting unit 41 via the second switch SW2. The liquid detecting apparatus 10*b* may be configured in such a manner that either one of these first driving unit 11*a* and second driving unit 11*b* outputs a pulse waveform voltage whereas the other thereof outputs a certain fixed/constant voltage. Or, the liquid detecting apparatus 10*b* may be configured in such a manner that these first driving unit 11*a* and second driving unit 11*b* output pulse waveform voltages that differ from each other. As explained in the first and second exemplary embodiments of the invention, after the application of the driving signal, which is performed by each of the first driving unit 11*a* and the second driving unit 11*b*, each of the first switch SW1 and the second switch SW2 is set OFF. As a result thereof, detection signals are output, which pass through the high-pass filtering unit 35 and then enter the differential amplification unit 30. Thereafter, a differential amplification detection signal is input from the differential amplification unit 30 into the signal detection unit 12.

(2) In each of the foregoing exemplary embodiments of the invention, it is explained that the liquid container 40 is configured as a discrete attachment unit that is separated from the liquid detecting apparatus 10, or, in other words, the liquid detecting apparatus 10 is configured as a discrete main unit that is separated from the liquid container 40. This means that the liquid detecting unit 41 is separated from the liquid detecting apparatus 10. However, the scope of the invention is not limited to such an exemplary configuration. As a non-limiting modification example thereof, the liquid detecting unit 41 may be provided in the liquid detecting apparatus 10. Even in a case where the above-described modified configuration is adopted, it is possible to obtain the same advantageous effects as those offered by the liquid detecting apparatus 10 (10*a*) and the liquid container 40 according to each of the foregoing exemplary embodiments of the invention.

(3) In each of the foregoing exemplary embodiments of the invention, it is explained that the high-pass filtering unit 35 has RC filter circuits as its circuit components. However, the scope of the invention is not limited to such an exemplary configuration. As a non-limiting modification example thereof, the high-pass filtering unit 35 may have LR filter circuits as its circuit components.

(4) In the second embodiment of the invention described above, liquid is taken as an example of a noise source that causes exogenous noise. However, the noise source that causes exogenous noise is not limited to liquid. For example, if the first electrode 41*a* is provided at a position close to an exogenous noise source such as a fluorescent lamp or an external signal line, though not limited thereto, the third capacitor C3 is provided on the noise-susceptible-side signal line that is electrically connected to the first electrode 41*a*. That is, the configuration of the liquid detecting apparatus 10*a* according to the second embodiment of the invention described above provides an effective solution to a noise problem, which is applicable as long as there is a difference in an exogenous noise that arises at the first electrode 41*a* of the liquid detecting unit 41 and an exogenous noise that arises at the second electrode 41*b* thereof due to any kind of a noise source.

(5) In each of the foregoing exemplary embodiments of the invention, an ink-jet printer is taken as an application example of the liquid detecting apparatus 10 (10*a*). However, the applications of the invention are not limited to such a specific example. That is, the invention can be embodied and/or implemented in the form of various kinds of liquid detecting apparatuses that detect the presence/absence of liquid. As a non-limiting application example thereof, the invention can be embodied and/or implemented as a fuel-amount detecting apparatus that detects the minimum fuel amount of fuel contained in a fuel tank.

Although the present invention is explained above while discussing exemplary embodiments as well as variations and modifications thereof, the specific embodiments, variations, modifications, and other examples described above are provided solely for the purpose of facilitating the understanding of the invention. It should be noted that, in no case, these explanatory embodiments are interpreted to limit the scope of the invention. Without departing from the spirit of the invention as well as the scope of appended claims, the invention may be changed, altered, modified, adapted, or improved by a person skilled in the art within his/her arbitrary discretion. It is the intention of the inventor/applicant that the scope of the invention covers any equivalents without departing therefrom.

What is claimed is:

1. A liquid detecting apparatus that drives a liquid detecting section that outputs two detection signals having phases opposite to each other in accordance with the amount of liquid, the liquid detecting apparatus comprising:

a driving section that outputs a driving signal to the liquid detecting section;

a differential amplifying section that performs differential amplification on said two detection signals that are output from the liquid detecting section on the basis of the driving signal so as to output a differential amplification detection signal; and a signal detecting section that makes a judgment as to whether the amount of liquid is not less than a predetermined amount or not by means of the differential amplification detection signal input from the differential amplifying section, wherein the liquid detecting section has a first electrode and a second electrode; and the differential amplifying section has the first input portion to which the first electrode of the liquid detecting section is electrically connected and the second input portion to which the second electrode of the liquid detecting section is electrically connected, and wherein one of the first electrode of the liquid detecting section and the second electrode of the liquid detecting section is provided at a position that is more susceptible to an external noise than a position at which the other of the first electrode of the liquid detecting section and the second electrode of the liquid detecting section is provided; and a high-pass filtering section has a capacitor portion having the same capacitance as that of the liquid detecting section, the capacitor portion being provided at a side where one of the first electrode of the liquid detecting section and the second electrode of the liquid detecting section that is more susceptible to the external noise than the other thereof is electrically connected.

2. The liquid detecting apparatus according to claim 1, further comprising the high-pass filtering section that is provided between the liquid detecting section and the differential amplifying section.

3. The liquid detecting apparatus according to claim 1, wherein a switch that electrically connects the driving section and the first electrode or electrically disconnects the driving section from the first electrode is provided between the driving section and the first electrode.

4. The liquid detecting apparatus according to claim 1, wherein the driving section includes a first driving section and a second driving section; a first switch that electrically connects the first driving section and the first electrode or electrically disconnects the first driving section from the first electrode is provided between the first driving section and the first electrode; and a second switch that electrically connects the second driving section and the second electrode or electrically disconnects the second driving section from the second electrode is provided between the second driving section and the second electrode.

5. A liquid ejecting apparatus that is provided with the liquid detecting apparatus according to claim 1, the liquid ejecting apparatus comprising:

a plurality of apparatus-side terminals that contact a plurality of terminals of the liquid detecting section, the plurality of apparatus-side terminals constituting an attachment portion to which a liquid container is attached, wherein the liquid detecting section that has the plurality of terminals is provided in the liquid container that can be detachably attached to the liquid detecting apparatus;

the driving section is electrically connected to one of the apparatus-side terminals; and the signal detecting section is electrically connected to one of the apparatus-side terminals via the differential amplifying section.

6. The liquid detecting apparatus according to claim 1, wherein the liquid detecting section further comprising:

a piezoelectric element, which is deformed due to electrostrictive effect when the piezoelectric element is turned on, and vibrates at a natural vibration frequency when the piezoelectric element is turned off after being turned on for a predetermined period of time.

7. The liquid detecting apparatus according to claim 6, wherein the two detection signals correspond to a counter-electromotive voltage of the piezoelectric element.

* * * * *